US005785342A

United States Patent [19]

Bronson

[11] Patent Number: 5,785,342

[45] Date of Patent: Jul. 28, 1998

[54] SKI BINDING DAMPENING ASSEMBLY

[76] Inventor: Henry D. Bronson, 904 St. Stephens Green, Oakbrook, Ill. 60521

[21] Appl. No.: 685,423

[22] Filed: Jul. 30, 1996

[51] Int. Cl.[6] ..... A63C 5/075

[52] U.S. Cl. ..... 280/602; 280/607

[58] Field of Search ..... 280/602, 607, 280/610, 618, 634, 636, 633, 14.2

[56] References Cited

U.S. PATENT DOCUMENTS

| | | | |
|---|---|---|---|
| 3,260,532 | 7/1966 | Heuvel . | |
| 3,917,298 | 11/1975 | Haff . | |
| 4,135,736 | 1/1979 | Druss | 280/636 |
| 4,294,460 | 10/1981 | Kirsch . | |
| 4,773,659 | 9/1988 | Rygiel | 280/142 |
| 4,896,895 | 1/1990 | Bettosini . | |
| 5,016,901 | 5/1991 | Mayr . | |
| 5,026,086 | 6/1991 | Guers et al. . | |
| 5,167,424 | 12/1992 | Baggio et al. . | |
| 5,197,752 | 3/1993 | Engelbert et al. . | |
| 5,207,445 | 5/1993 | Hoelzl . | |
| 5,211,418 | 5/1993 | Scherübl . | |
| 5,242,188 | 9/1993 | Bigler et al. . | |
| 5,344,176 | 9/1994 | Trimble | 280/602 |

FOREIGN PATENT DOCUMENTS

| | | | |
|---|---|---|---|
| 521272-A1 | 1/1993 | France | 280/602 |
| 623370-A1 | 11/1994 | France | 280/602 |
| 2 255 406 | 5/1974 | Germany . | |
| 2 259 375 | 6/1974 | Germany . | |
| 26 01 951 | 9/1977 | Germany . | |
| 26 34 748 | 2/1978 | Germany . | |
| 572 350 | 2/1976 | Switzerland . | |
| WO 83/03360 | 10/1983 | WIPO | 280/602 |
| WO 93/12845 | 7/1993 | WIPO | 280/607 |
| WO 93/16769 | 9/1993 | WIPO | 280/607 |

*Primary Examiner*—Brian L. Johnson
*Assistant Examiner*—Bridget Avery
*Attorney, Agent, or Firm*—Brinks Hofer Gilson & Lione

[57] ABSTRACT

A dampening assembly includes an elongated plate, an elastomeric pad, and a series of bolts located along a centerline of the ski. The bolts are inserted through slots along the centerline of the plate and through openings in the elastomeric pad before being tightened into threaded nuts fixed to the ski. A rigid spacer is secured within each opening in the elastomeric pad. The spacers each include a raised portion with a hole defined within it to receive one of the mounting bolts. The raised portion is freely slidable within the slot of the plate when the plate is positioned on top of the pad. The pad is thus sandwiched between the metal plate and the ski to dampen vibration between them. Dampening of the plate is further assisted by the placement of a small elastomeric insert between the raised portion and one of the ends of the slot.

19 Claims, 6 Drawing Sheets

Fig. 2
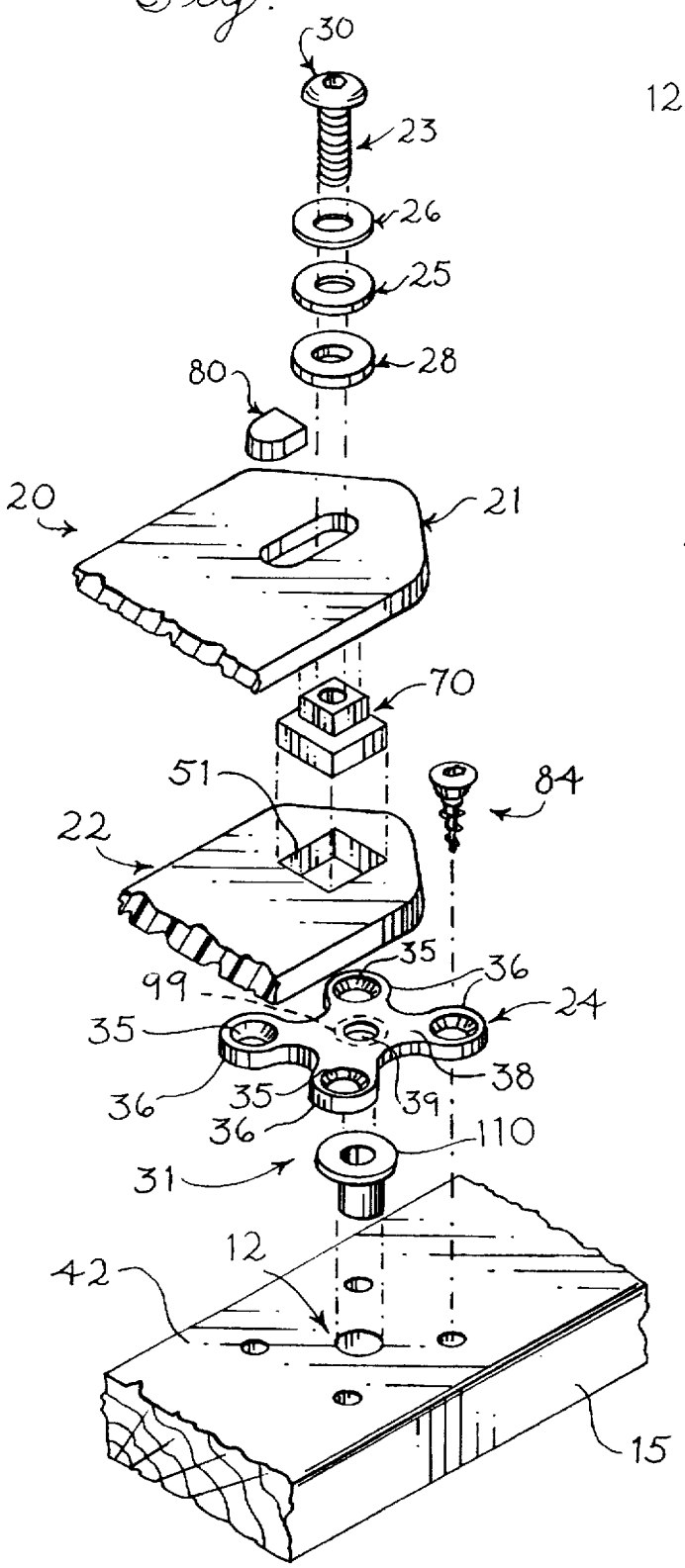
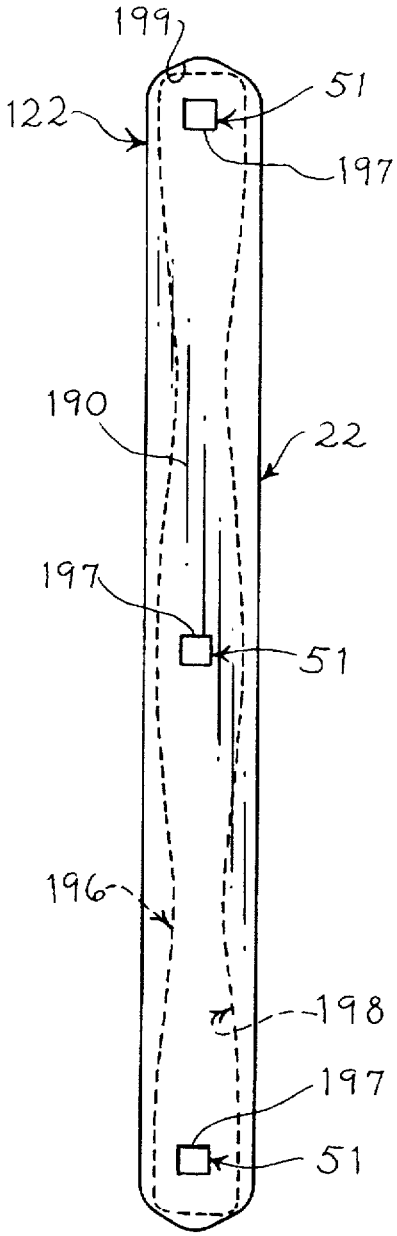
Fig. 8

SKI BINDING DAMPENING ASSEMBLY

BACKGROUND OF THE INVENTION

The present invention relates generally to boot binding systems for skis, and in particular to a vibration dampening assembly for use with such binding systems.

Snow ski design and manufacture has steadily advanced from simple solid wood models of the 1940's to composite laminates of materials which have sharp steel edges for resisting turning forces, fast running surfaces for speed, varying flexibility for optimum performance at various speeds and in various conditions, and high torsional rigidity and side cut for better turning performance. Likewise, binding technology has advanced from simple straps, to fixed toe guides and hold down cables, and finally to advanced safety release bindings.

A skier can control his skiing direction only when his skis are in contact with the snow. When in the air, the skier can only position his body and skis so that when he lands, he immediately regains control. The skis often may leave the snow completely when the skier purposely jumps or lifts off bumps in the snow. The skis can also partially leave the snow inadvertently, however, because the skis are unable to flex adequately with the terrain, or because of longitudinal vibration from small chunks of ice or snow. These vibrations can be dangerous by causing the skier to lose adequate control. Wind and air drafts around the moving ski can also have this effect.

Attempts to solve the vibration problem have included attaching plates to the ski and padding the ski with elastomeric material. The plates are mounted beneath the ski boot binding and can serve to dampen the longitudinal vibration of the ski. The dampening action improves the skier's performance by allowing the skis to flex more uniformly under the foot, thereby facilitating contact between the ski and the snow. Single pads, multiple pads, and spring systems have been used for the elastomeric component of these dampening assemblies, and various plate shapes have also been used.

These plate and pad combinations have several shortcomings, however. For example, several mounting bolts are needed to mount the plate and pad to the ski. The mounting bolts create a rigid connection between the ski and the plate, and, as a result, dampening is reduced at these bolted points. The location of these bolts is usually adjacent to the edges of the ski, thereby reducing the lateral, or edge-to-edge, dampening by not allowing the plate and pad to have adequate edge-to-edge flexure. Consequently, dampening is compromised when the skis "chatter" or vibrate when some turns are executed under icy conditions. When the skier is in the middle of a turn, maximum gravity and centrifugal forces combine to produce extremely heavily loaded edges under and near the boots. Because some skis possess high torsional rigidity at these points, improved lateral dampening becomes increasingly important.

Other shortcomings are apparent with previous dampening systems having multiple dampening pads or springs. Such systems may include many small parts which may be lost when the bindings are disassembled for maintenance or modification. Furthermore, the use of multiple dampening pads may reduce strength and stability in the binding to some degree.

Therefore, there is a need for a dampening assembly that improves lateral dampening while maintaining a secure interface between the binding and the ski.

There is also a need for a dampening assembly that allows the user to easily replace the elastomeric dampening pad to modify the dampening characteristics of the assembly.

SUMMARY OF THE INVENTION

Accordingly, the present invention is directed to a dampening assembly for skis that substantially obviates one or more of the above problems due to limitations and disadvantages of the related art.

To achieve these and other advantages, and in accordance with the purposes of the present invention, as embodied and broadly described, the dampening assembly for a ski includes an elongated plate, an elastomeric pad, and a series of bolts located along a centerline of the ski. In this configuration, the bolts hold the plate in place over the ski, with the elastomeric pad securely sandwiched in between. The centerline location of the bolts improves the lateral dampening of the assembly.

In another aspect of the invention, the dampening assembly includes rigid spacers secured within the openings in the elastomeric pad. The spacers each include a raised portion having a hole defined therein to receive one of the mounting bolts. The raised portion is freely slidable within the slot in the plate when the plate is positioned on the pad and spacer. Dampening of the plate in the forward and reverse directions is further assisted by the placement of a small elastomeric insert in a slot guide defined by an edge of the raised portion and one of the ends of the slot.

The preferred embodiment of the dampening assembly described herein provides excellent vibration-absorbing performance in all directions. The assembly maintains the longitudinal or lengthwise dampening characteristics of previous designs while improving the lateral (edge-to-edge) dampening characteristics. This is accomplished by using the sliding slot guide which does not act on the plate to provide lateral rigidity. Rather, the guide acts on the plate predominantly with line contact only along the centerline of the plate. The stiffness of the plate is therefore not used to directly resist forces on the edges of the skis. The plate instead resists these forces via the interposed elastomeric pad. In addition to these advantages, the assembly allows for simplified removal or changing of the elastomeric pad.

The invention, together with further objects and attendant advantages, will best be understood by reference to the following detailed description of the preferred embodiments, taken in conjunction with the accompanying drawings.

BRIEF DESCRIPTION OF THE DRAWINGS

FIG. 2 is an exploded perspective view of a portion of the dampening assembly of FIG. 1.

FIG. 8 is a top view of an alternative elastomeric pad capable of use with the assembly of FIGS. 1–4 showing a cavity defined therein.

DETAILED DESCRIPTION OF THE PREFERRED EMBODIMENTS

Figure 1:
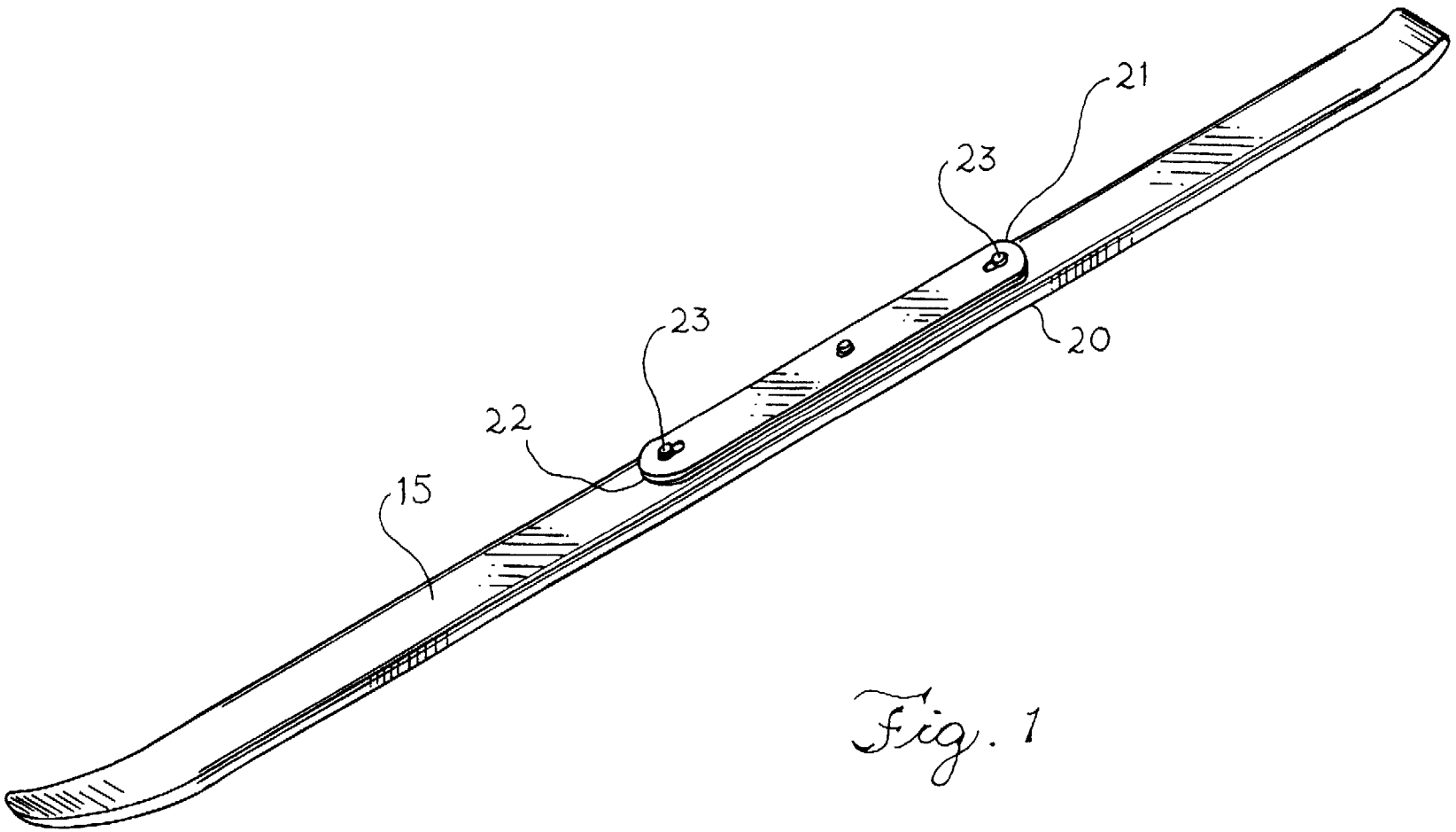
FIG. 1 is a perspective view of a preferred embodiment of a dampening assembly of the present invention mounted to a ski.

Referring now to the drawings, and more particularly to FIG. 1, a preferred embodiment of a dampening assembly 20 is illustrated mounted to a conventional ski 15. The assembly 20 includes a flat, elongated rigid or semi-rigid plate 21 approximately 2.5 mm thick. The plate 21 is preferably made from a lightweight metal such as aluminum. Sandwiched between the plate 21 and the ski 15 is an elongated pad 22. The pad 22 is preferably molded from an elastomeric material such as polyurethane or neoprene rubber. The materials may be modified based on desired dampening or handling characteristics. Furthermore, the pad may be shaped to offer the skier a variety of cant angles.

The assembly 20 is secured to the ski 15 via three mounting bolts 23 inserted into the plate 21, through the pad 22, and secured to the ski 15. A conventional ski binding and boot (not shown) may be mounted on top of the plate 21 using conventional means (not shown).

Figure 3:
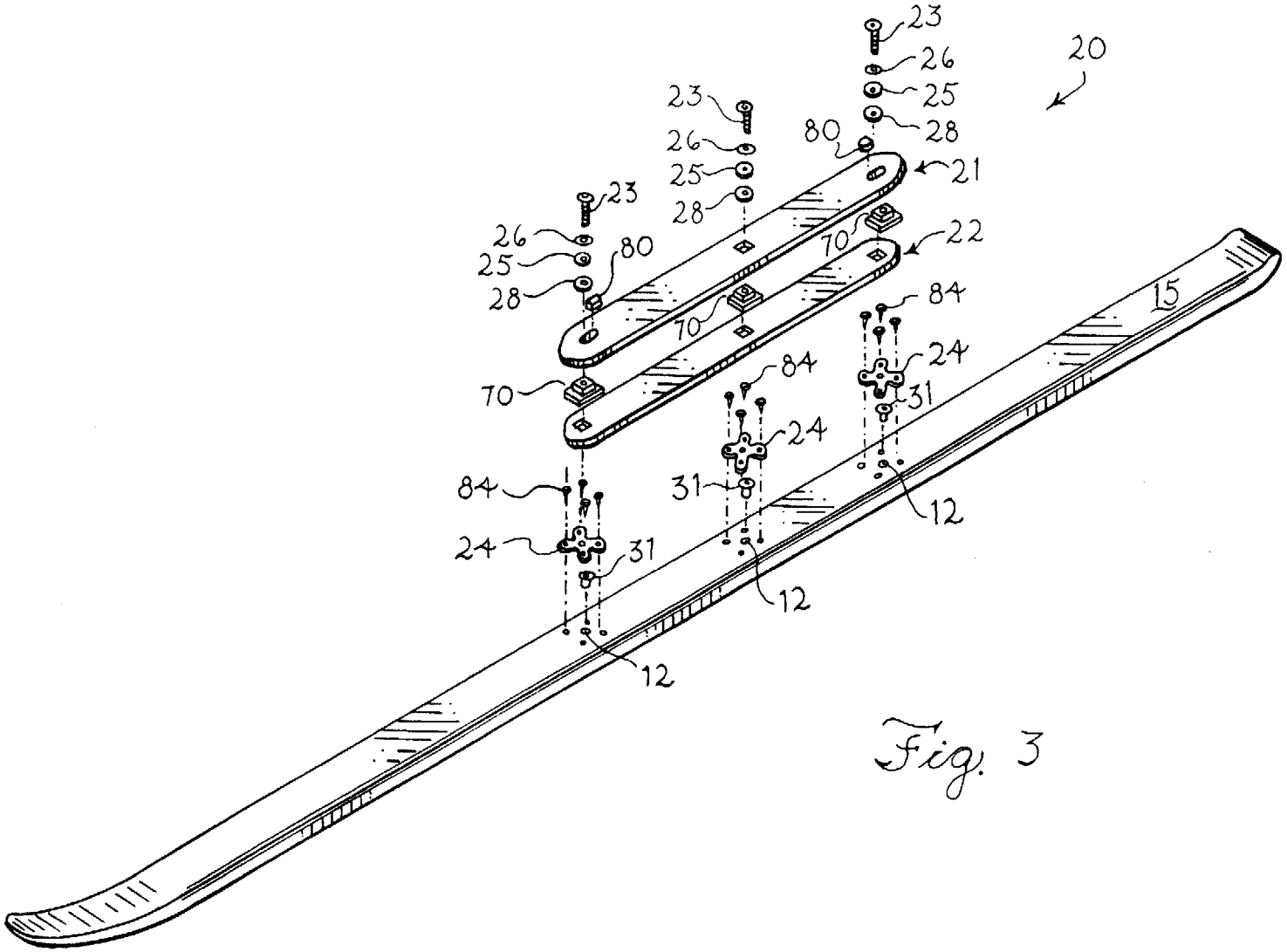
FIG. 3 is an exploded view of the ski shown in FIG. 1.

Generally, as can be seen in the exploded drawings of FIGS. 2 and 3, the mounting bolts 23 are conventional machine-type screws. The bolts 23 have heads 30 which hold a series of washers 25, 26 and 28 to the plate 21 when assembled. In particular, washers 25 are preferably molded from an elastomeric material similar to the material of the pad 22. Metal cover washers 26 are of a downwardly cupped shape and cover the elastomeric washers 25 when the bolts 23 are in place. Plastic washers 28, preferably molded from plastic or nylon, sandwich washers 25. Preferably, washers 25, 26 and 28 are bonded together into one unit by a conventional adhesive. The simple, overall flat plate design avoids direct contact between the plate 21, the ski 15, and the mounting bolts 23 at almost all points, thereby providing omni-directional dampening. The combination of washers 25, 26 and 28 provide dampening in a direction perpendicular to the plane of plate 21.

Figure 4:
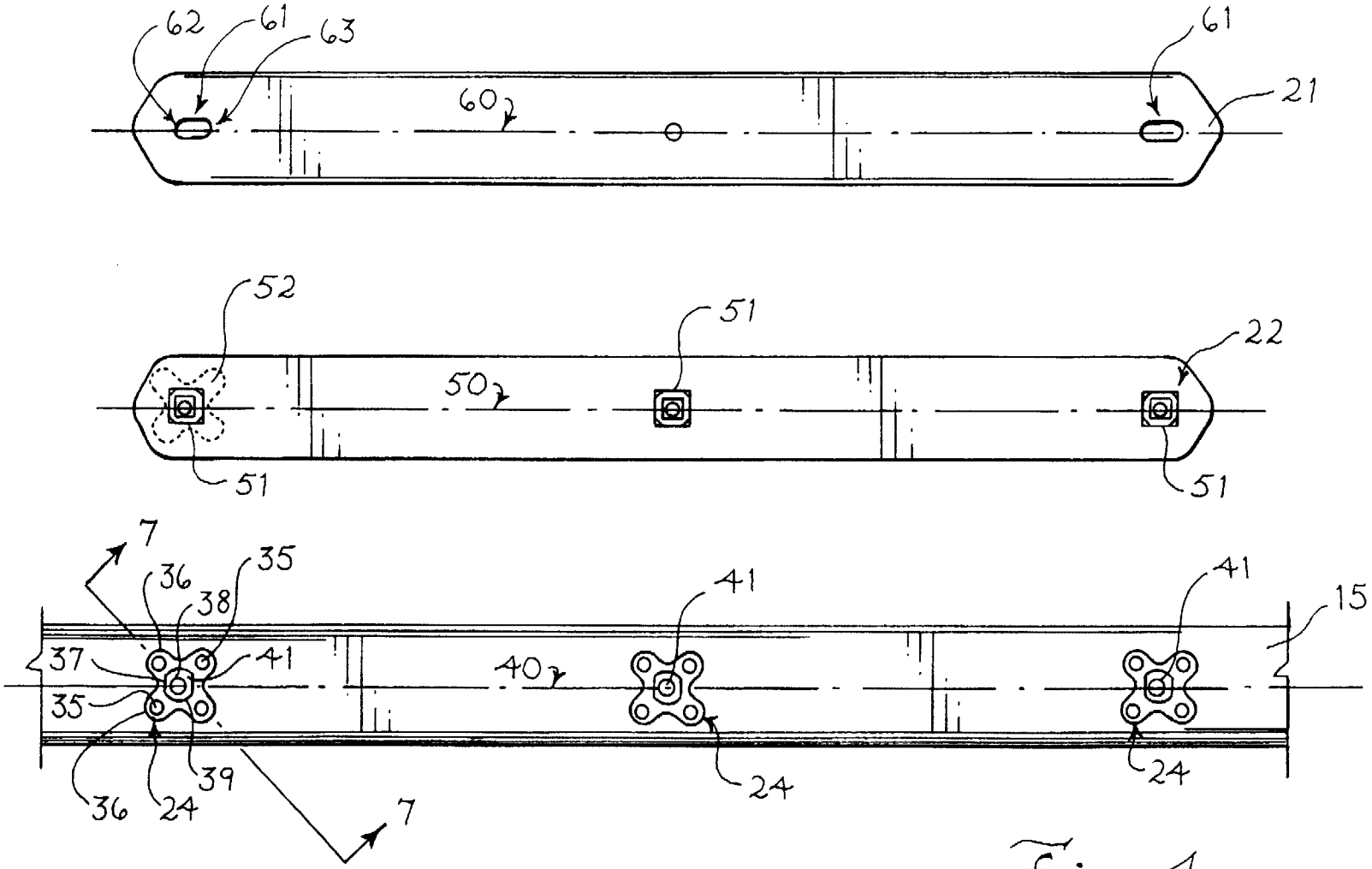
FIG. 4 is a top view of the separated dampening assembly of FIGS. 1–3.

As shown in the top views of FIG. 4, the elastomeric pad 22 and the metal plate 21 are an elongated shape. The mounting bolts 23 fasten the plate 21 and pad 22 to the ski 15 through various openings defined in these elements. Ski 15 has three holes 41 defined in the top surface 42 along the centerline 40 of ski 15. The elastomeric pad 22 has three larger, square-shaped openings 51 defined along the centerline 50 to align with the holes 41 on the ski 15. Finally, two elongated slots 61 are defined within plate 21 along its centerline 60, one on each end of the plate. Each slot 61 has a front end 62 and rear end 63. The centerline 60 of plate 21 and the centerline 50 of the pad 22 are aligned with the centerline 40 of ski 15 when the openings are properly aligned for insertion of the bolts 23. This centerline mounting configuration provides unidirectional damping without rigid contact between the plate 21 and the ski 15 at the edges. Preferably, the pad 22 is 55 mm wide, and thus extends most of the width of the 59 mm-wide plate 21.

As shown more clearly in FIG. 2, the mounting bolts 23 are preferably held to the ski 15 using threaded tee nuts 31 and clamps 24. Each tee nut 31 has a flatted head 110 and is permanently fastened to the ski 15 by imbedding it in one of the holes 12 pre-drilled into the ski 15 during manufacture, or by fastening securely to the ski 15 using a clamp 24 as shown. The clamp 24 is held to the ski 15 using a multiplicity of wood screws 84. The mounting bolts 23 are received by the tee nuts 31 and may be tightened to the ski 15 by turning the bolts 23 into the tee nuts 31.

Referring now to FIG. 4 and the previous figures, each clamp 24 is shaped to avoid excess weight, and includes a flat central surface 38 having an opening 39 defined within it. Four flanges 36 project outward from the central surface 38 of clamp 24, and each flange 36 has a hole 35 for receiving one of four wood screws 84. The clamp 24 is preferably made from lightweight metal such as aluminum, and may be permanently mounted to the surface 42 of ski 15. The clamps 24 all have a shaped spot face recess 99 on the underside to accommodate the flatted head 110 of the tee nuts 31 so that the nuts are retained in the ski and are prevented from rotating, allowing repeated assembly and removal.

The plate 21 is oriented so that two screw holes 35 and the mounting bolt opening 39 form a line at 45 degrees to the centerline 40 of the ski 15. This orientation is preferred because it avoids having three holes in line across the ski which would could result in a line of higher stress concentration as the ski is flexed. It also results in a minimum clamp length along the ski while maintaining the above advantage.

It is recognized that the clamp 24 itself, firmly fastened to the ski 15, increases the stiffness of the assembly 20, and its size should therefore be minimized. Since the combined length of the three clamps 24 is less than the combined length of the ski binding, overall flexibility of the ski 15 under the binding and pad 22 combination is more uniform.

The clamps 24 are positioned on top of the surface 42 of ski 15, and are fully concealed beneath the elastomeric pad 22. The notches 52 in the pad 22 are approximately 22 mm deep to accommodate the 22 mm thick clamps 24.

The present embodiment also uses three identical clamps, and it is preferred that at least the clamps at the ends of the plate 21 are identical. This allows the pad 22 and the plate 21 to be symmetric about the lengthwise and crosswise axes.

Figure 5:
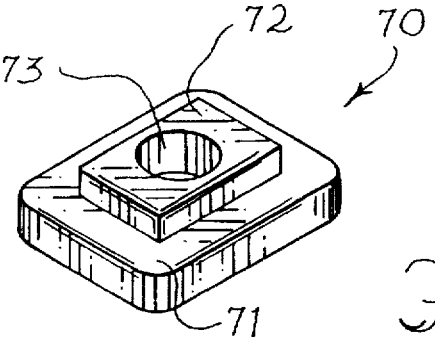
FIG. 5 is a perspective view of a rigid spacer of the embodiment of FIGS. 1–4.

To further improve the lateral dampening in the assembly 20, a sliding guide system is provided along the centerline 60 of the plate 21 to supply lateral rigidity while minimizing rigid contact between the plate 21 and the ski 15. The guide system uses a square-shaped spacer 70 illustrated in detail in FIG. 5 to limit rigid contact between the plate 21 and ski 15. The spacer 70 is preferably molded from a plastic material, such as nylon, and includes a base portion 71 and raised portion 72 molded to the base portion 71. A hole 73 is defined completely through the spacer 70 and is of a size large enough to loosely accommodate mounting bolt 23.

Figure 7:
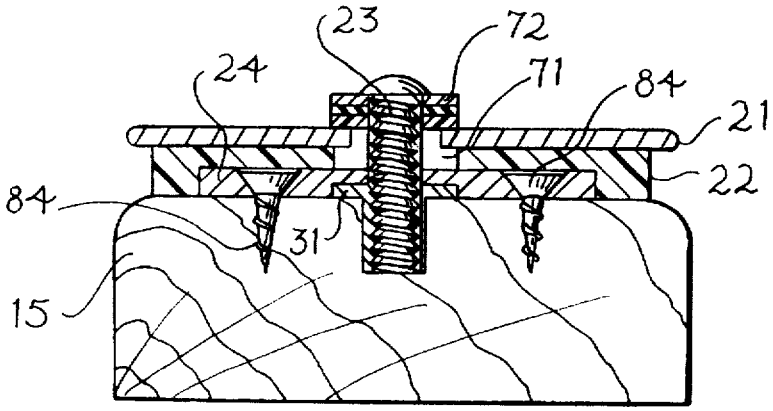
FIG. 7 is a sectional view taken along line 7—7 of FIG. 6, including additional mounting hardware.
Figure 6:
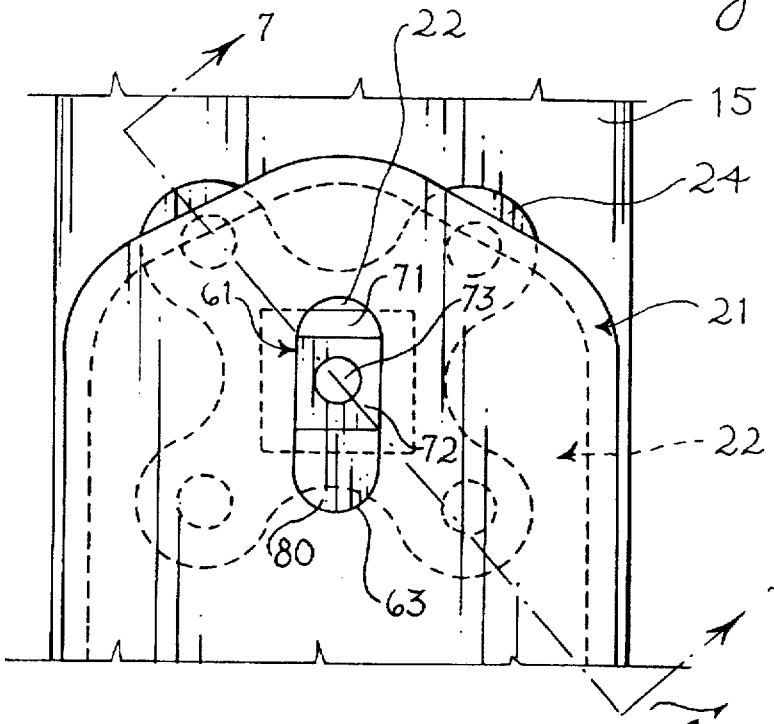
FIG. 6 is a top view assembly drawing of the plate and spacer of FIGS. 4 and 5.

The positioning of spacer 70 in relation to the other parts of the assembly 20 is shown in FIGS. 6–7 and the previous figures. FIG. 6 shows the assembled components of the binding assembly 20, including the clamp 24 and elastomeric pad 20 located beneath plate 21. FIG. 7 is a sectional view of the secured assembly 20 taken along line 7—7 of FIG. 6 and including bolt 23 and tee nut 31. In this figure, the attachment of the clamp 24 to the ski 15 via screws 84 can be seen. The bolt 23 has been screwed into tee nut 31, which is in turn held in the ski by clamp 24.The base portion 71 fits snugly within square-shaped hole 51 in elastomeric pad 22. The raised portion 72 thus projects slightly from the top surface of the pad 22. When the metal plate 21 is positioned on top of the pad 22, the raised portion 72 fits within slot 61 in plate 21. Although the raised portion 72 of the spacer 70 fits snugly, the raised portion 72 of the spacer 70 is able to slide freely within the slot 61. Thus, the pad 22 and rigid spacer 70 may move as a unit relative to the plate 21.

In order to dampen the free movement of the spacer 70 within slot 61, an elastomeric insert 80 is placed in the rear end 63 of slot 61 between the raised portion 72 and the edge of the rear end 63. The elastomeric insert is preferably molded from rubber or other materials similar to those used for pad 22. Because the front end 62 of slot 61 is narrowed, the raised portion 72 is prevented from sliding completely to the front end 62 of the slot 61. When the spacer 70 is urged toward the rear end 63 of the slot 61, such movement is hindered by the elastomeric insert 80, thereby providing a dampening effect. When assembled, the metal plate 21 is held in place via the mounting bolt 23 inserted through the hole 73 in the spacer 70.

When a ski is flexed in the bottom of a bump such as a mogul so that the tips and tails of the ski are forced above the boot, the flex is in a positive direction, and the skier instantaneously feels positive pressure on the bottom of his feet—often a multiple of "g" or gravity forces. When this occurs in the embodiment illustrated above, the plate 21 also flexes, but not as much as the ski 15. Therefore, the outside fasteners 90 and 91 tip inward, and even translate inward slightly, moving the spacer 70 within the slot 61 and compressing elastomeric insert 80. An instant later, when the ski 15 is out of the mogul's trough, the ski 15 springs back to its normal flex, aided by the rebound of insert 80.

Prior art dampening plates have used bi-directional dampening with inserts similar to insert 80 on both sides of sliding spacer 70 in elongated slots 61. Since space is limited and an elongated slot 61 weakens the plate 21 if made excessively long, using this space in a single direction to better dampen positive g forces is preferred over sacrificing space to dampen negative g forces. A skier generally will not generate more than −0.5 g on the ski by being in a "free fall" condition after a jump (zero g) and simultaneously retracting the ski rapidly by bending his knees. Conversely, skiers regularly generate positive g forces exceeding 2 g on almost every turn. Under racing conditions, forces regularly exceed multiples of the 2 g forces generated in recreational skiing.

Fastening the assembly only along the ski centerline improves the performance of the ski during use. The centerline mount allows a dampened rocking of the plate depending on the instantaneous edge load of the ski during use.

The use of the single, elongated elastomeric pad 22 in this assembly 20 has several advantages. First, the pad 22 dampens the entire plate 21, yet allows the pad 22 to be shaped to both reduce weight and improve lateral dampening. The openings in the pad 22 also reduce pad sliding with respect to the ski 15 and the plate 21. Finally, the pad 22 can be produced with non-parallel edge surfaces to provide an effective method of varying the cant angle between the ski edges and the binding release surfaces.

An alternate embodiment of the pad 122 is shown in FIG. 8. The pad 122 has a cavity 190 defined within its bottom, which reduces the weight of the pad 122. The cavity 190 also improves lateral dampening by reducing the area in contact with the ski 15, thereby increasing the unit load on the edges 195 of the pad 122. Preferably, the recess 190 in the pad 122 is at least deep enough to fit over the clamps 24.

The cavity 190 preferably includes two vertical surfaces 195 which are the edge of the cavity 190 and extend over the length of the pad 122. Furthermore, as shown by points 196 and 198, the surfaces 195 become thicker or thinner based on the distance away from the plate holes 197 defined in the pad 122. The surfaces 195 and pad 122 are subject to deformation as the pad 122 is compressed. The cavity shape is modified along the length of the pad 122 to provide a more uniform side-to-side deflection of the plate 21, thereby minimizing the torsional stress concentrations in the plate 21. The cavity 190 may define multiple cavities or cavities of different shapes. Since all torsional forces placed on the plate are from binding connection points for the ski boot, the area of contact of the pad 122 is greatest under the probable binding connection points, and reduces as the distance from these points is increased.

Figure 10:
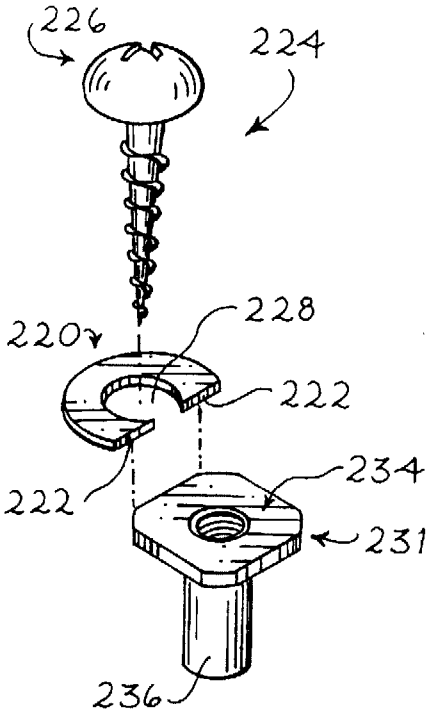
FIG. 10 is an exploded view of a portion of the mounting assembly of FIG. 9.
Figure 9:
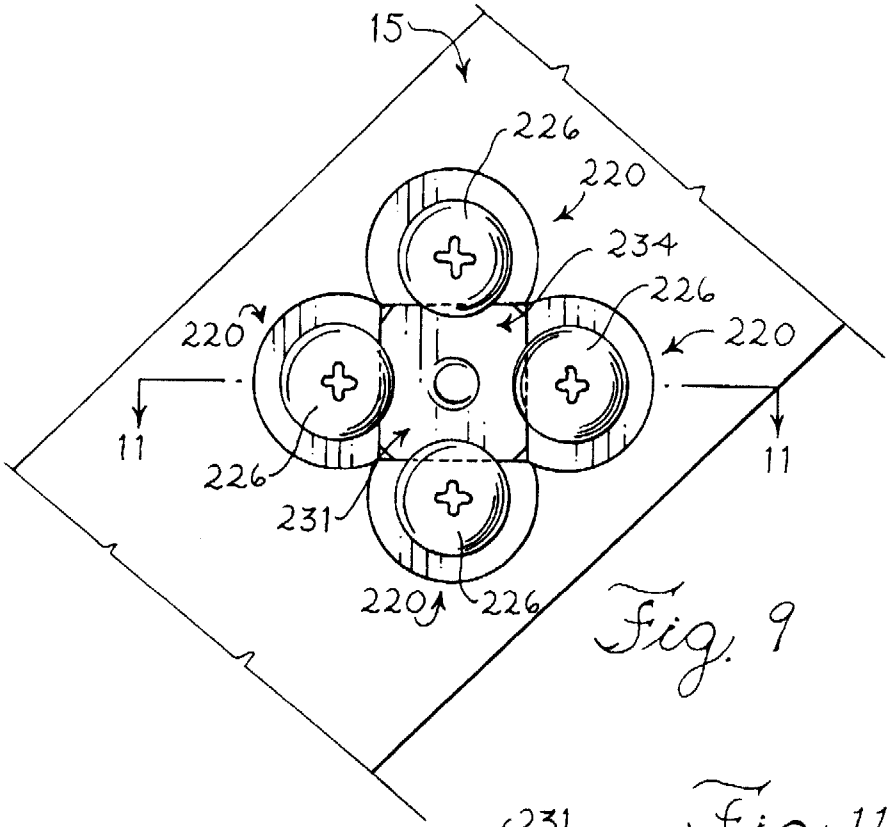
FIG. 9 is a top view showing an alternative embodiment of a mounting device capable of use with the dampening assembly of FIGS. 1–7.
Figure 11:
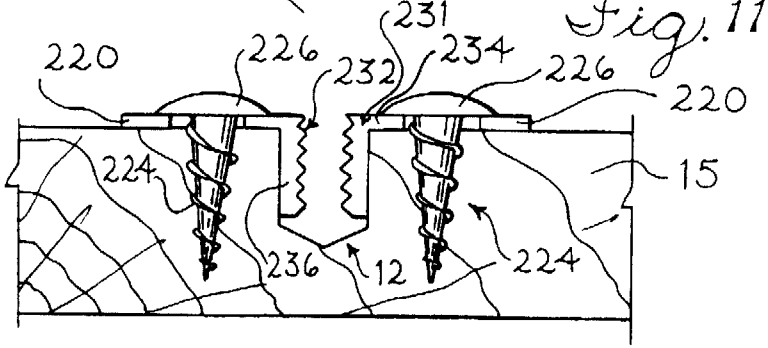
FIG. 11 is a sectional view taken along line 11—11 of FIG. 9.

An alternative embodiment of a portion of the mounting assembly 20 is shown in FIGS. 9—11. In this embodiment, the clamps 24 shown in the previous figures need not be used to fasten the other components of the assembly 20 to the ski 15. In particular, as shown in FIG. 9, a square-shaped tee nut 234 is held to the ski 15 using four metal washers 220 and four wood screw heads 226. As can be more easily seen in FIG. 10, each washer 220 has a cut side 222 which allows it to be positioned flush with the flatted head 231 of tee nut 234. The interiorly threaded insertion base 236 of the tee nut 234 may be inserted into the ski 15 through a pre-drilled hole 12, as shown in FIG. 11. The flat sides of the flatted head 231 of tee nut 234 can each accommodate one of the cut washers 220. Once the tee nut 234 is positioned inside ski 15, each washer 220 may be positioned around the flatted head 231 and each secured in place by a wood screw 224. Each wood screw 224 has a head 226 which is large enough so that, when the wood screw 224 is inserted through the hole 228 in each washer 220, the head 226 overlaps both the washer 220 and a portion of the flatted head 231 of the tee nut 234. This allows the wood screws 224 to securely hold the tee nut 234 in place to the ski 15. The mounting bolt 23 may then be threaded into the center of the tee nut 234 to secure the previously described components to the ski 15.

This alternate method of mounting the tee nuts and the components of the assembly to the ski 15 allows for a mounting assembly which uses less metal. Thus, the weight of the assembly is significantly lightened.

Furthermore, the simplified attachment method for the dampening assembly affords several practical advantages for the user. For example, only one binding/plate combination needs to be purchased for multiple pairs of skis. This results in a higher degree of safety because there is less chance of improper adjustment of the bindings. In addition, elastomeric pads of different hardness and/or compliance characteristics can be changed while on the slopes to more easily and more effectively accommodate changed snow or race course conditions. The metal mounting bolts allow simplified installation and removal without loss of thread strength, thus allowing the skier to repeatedly utilize multiple different pairs of skis with one set of plates and bindings.

Finally, elastomeric pads with precisely measured cant angles may be used to position the skier's knees to an optimum natural position with respect to the ski edges. Sometimes skiers try to adjust canting angles by modifying the bottom of the boot. Such modifications can compromise the dependability of the safety binding release by destroying the parallel interface between the binding hold-down lips and the boot sole.

Of course, it should be understood that a wide range of changes and modifications can be made to the preferred embodiment described above. For example, the rigid spacer may be integral with the elastomeric pad or the elastomeric insert. Furthermore, the shapes and/or orientations of the various components may differ. Thus, it is intended that the foregoing detailed description be regarded as illustrative rather than limiting and that it be understood that it is the following claims, including all equivalents, which are intended to define the scope of this invention.

I claim:

1. A dampening assembly for a ski, said assembly comprising:

a ski;

an elongated plate defining a plurality of slots along a centerline of said plate, each of said slots having a front end and a rear end;

an elastomeric pad positioned within the width of said plate and disposed between said plate and said ski, said pad defining at least one opening adjacent each end of said pad;

a rigid spacer having a base portion and a raised portion, said base portion disposed within one of said openings in said pad;

an opening defined in said raised portion through said base portion, said opening sized to receive one of a plurality of mounting bolts;

said raised portion of said rigid spacer disposed within said slot in said plate when said plate is positioned over said pad, said raised portion freely slidable within said slot between said front end and said rear end;

an elastomeric insert disposed between said raised portion of said rigid spacer and said rear end of said slot;

a cover washer held against said plate by said mounting bolt, said cover washer sized to retain said insert within said slot;

a plurality of mounting bolts positioned along a centerline of said plate for securing said plate and pad to said ski; and a plurality of clamps mounted to said ski along a centerline of said ski, said clamps receiving said mounting bolts to retain said pad and plate against said ski.

2. The assembly of claim 1 wherein said clamps are mounted to said ski by a plurality of screws.

3. The assembly of claim 1 further comprising:

a tee nut, said tee nut receiving said mounting bolt to retain said pad and said plate against said tee nut; and a plurality of screws securing said tee nut to said ski.

4. The assembly of claim 1 further comprising:

an elastomeric washer positioned adjacent said cover washer.

5. The assembly of claim 1 wherein said elastomeric pad further comprises at least one elongated cavity defined on the bottom of said pad.

6. The assembly of claim 1 wherein said plate further comprises metal.

7. The assembly of claim 2 wherein each of said clamps further comprises:

a central portion defining an opening to receive one of said mounting bolts;

a plurality of circumferentially spaced flanges extending outwardly from said metal portion;

each of said flanges defining an opening for receiving one of said screws.

8. The assembly of claim 7 wherein said elastomeric pad further comprises a notched portion on an underside of said pad corresponding in shape to a portion of one of said clamps, said notched portion for closely receiving at least one of said clamps.

9. The assembly of claim 3 further comprising a plurality of washers mounted adjacent said tee nut for securing said tee nut to said ski.

10. The assembly of claim 9 wherein said washers each have at least one cut edge.

11. A dampening assembly for a ski, said assembly comprising:

an elongated elastomeric pad having at least two openings, each of said openings defined along a centerline of said pad adjacent each end of said pad;

an elongated plate covering said pad and defining at least two slots through a centerline of said plate, said slots positioned over said openings in said pad;

at least two nuts positioned below said openings and fastened to said ski using clamps; and at least one mounting bolt inserted into each of said slots in said plate, through said openings in said pad, and tightened to said nuts in said ski;

whereby said plate, pad and ski cooperate to provide omni-directional damping between said ski and said plate.

12. A dampening assembly for a ski, said assembly comprising:

an elongated elastomeric pad having at least two openings, each of said openings defined along a centerline of said pad adjacent each end of said pad;

an elongated plate covering said pad and defining at least two slots through a centerline of said plate, positioned over said openings in said pad, each of said slots having a rear end;

at least two nuts positioned below said openings and fastened to said ski;

at least two spacers positioned within said openings in said pad, said spacers each having a hole defined therein;

at least one mounting bolt inserted into each of said slots in said plate, through said spacers, and tightened to said nuts in said ski; and an elastomeric insert positioned between said spacer and said rear end of each of said slots;

a plurality of clamps having a central portion defining an opening to receive one of said mounting bolts, a plurality of circumferentially spaced flanges extending outwardly from a metal portion, each of said flanges defining an opening for receiving one of a plurality of screws, said clamps positioned on said ski along a centerline of said ski and affixed to said ski by said plurality of screws, said clamps receiving said mounting bolts to retain said pad and plate against said ski;

whereby said plate, pad, inserts and ski cooperate to provide omni-directional damping between said ski and said plate.

13. The assembly of claim 12 wherein said elastomeric pad further comprises a notched portion on an underside of said pad corresponding in shape to a portion of at least one of said clamps, said notched portion for closely receiving at least one of said clamps.

14. A dampening assembly for a ski, said assembly comprising:

an elongated plate;

an elastomeric pad positioned substantially within the width of said plate and disposed between said plate and said ski; and a plurality of clamp means for mounting said plate to said ski over said pad, said clamp means arranged along a centerline of said ski;

said elastomeric pad including a notched portion on an underside of said elastomeric pad corresponding in shape to a portion of at least one of said clamp means, said notched portion for closely receiving at least one of said clamp means.

15. The assembly of claim 14 wherein said clamp means comprises a member having a plurality of flanges for receiving screws for mounting said clamp means to said ski.

16. The assembly of claim 15 wherein said clamp means further comprises a member defining a central opening for receiving a mounting bolt.

17. The assembly of claim 16 wherein said plate defines at least one slot and said pad defines at least one opening, said slot and opening defined along a centerline of said ski, said mounting bolt passing through said slot and said opening to fasten said plate and pad to at least one of said clamp means.

18. The assembly of claim 16 wherein said plate defines at least one slot and said pad defines at least one opening positioned below said slot.

19. The assembly of claim 18 further comprising:

at least one nut positioned below said opening in said pad and fastened to said ski by at least one of said clamp means;

at least one spacer positioned within said opening in said pad, said spacers each having a hole defined therein;

said mounting bolt inserted into said slot in said plate, through said spacer, and tightened to said nut in said ski; and an elastomeric insert positioned between said spacer and an end of said slot.

* * * * *